United States Patent [19]

Noguchi et al.

[11] Patent Number: 4,938,276

[45] Date of Patent: Jul. 3, 1990

[54] METHOD AND APPARATUS FOR SUPPLYING A LEAD ALLOY TO A CASTING MACHINE

[75] Inventors: Kenji Noguchi; Shigeru Sato, both of Takatsuki, Japan

[73] Assignee: Yuasa Battery Company Limited, Japan

[21] Appl. No.: 471,676

[22] Filed: Jan. 25, 1990

Related U.S. Application Data

[63] Continuation of Ser. No. 318,422, Feb. 28, 1989, abandoned, which is a continuation of Ser. No. 40,048, Apr. 17, 1987, abandoned.

[30] Foreign Application Priority Data

Apr. 18, 1986 [JP] Japan ..... 90367

[51] Int. Cl.[5] ..... B22D 39/02

[52] U.S. Cl. ..... 164/133; 164/337; 222/309

[58] Field of Search ..... 164/133, 337, 316, 312, 164/155, 136, 335; 222/309

[56] References Cited

U.S. PATENT DOCUMENTS

| | | | |
|---|---|---|---|
| 3,371,186 | 2/1968 | Trabilcy | 164/337 |
| 3,815,659 | 6/1974 | Paulo et al. | 164/337 |

FOREIGN PATENT DOCUMENTS

| | | | |
|---|---|---|---|
| 52-52125 | 4/1977 | Japan | 164/316 |
| 55-5138 | 1/1980 | Japan | 164/316 |
| 57-39069 | 3/1982 | Japan | 164/133 |
| 58-53366 | 3/1983 | Japan | 164/337 |

*Primary Examiner*—Kuang Y. Lin

*Attorney, Agent, or Firm*—Watson, Cole, Grindle & Watson

[57] ABSTRACT

A molten lead alloy is supplied from a melting furnace to a casting machine through a feed pipe having a pair of ends connected with the furnace and the machine, respectively, and an intermediate portion situated at a level which is higher than the higher of the two levels of the molten alloy located adjacent to the ends, respectively, of the feed pipe by a distance exceeding the height of a column of the molten alloy which atmospheric pressure can support. An apparatus for supplying the molten alloy in such a way is also disclosed.

6 Claims, 2 Drawing Sheets

METHOD AND APPARATUS FOR SUPPLYING A LEAD ALLOY TO A CASTING MACHINE

This is a continuation application of Ser. No. 318,422, filed Feb. 28, 1989, which in term is a continuation application of Ser. No. 040,048, filed Apr. 17, 1987, and both now abandoned.

BACKGROUND OF THE INVENTION

1. Field of the Invention

This invention relates to a method of, and an apparatus for, supplying a lead alloy to a casting machine, particularly of the type which is used for manufacturing grids for lead batteries.

2. Description or the Prior Art

Grids for lead batteries are manufactured from a lead alloy, such as an alloy of lead and antimony or calcium. A casting machine of the type to which a lead alloy is fed by gravity is usually used for manufacturing those grids.

A number of systems for supplying the casting machine with a molten lead alloy at a constant rate are known. A first type of known supply system makes use of the head resulting from the difference in height between a melting furnace and a casting machine. The melting furnace is situated at a higher level than the molten alloy inlet of the casting machine. A feed pipe is connected between the bottom of the melting furnace and the inlet of the casting machine. The feed pipe is provided with a valve which is opened and closed to provide an appropriate supply of the molten alloy to the casting machine. The feed pipe is always filled with the molten alloy and no oxidation, therefore, occurs in the molten alloy in the feed pipe. As this system does not employ any rotary or overflow mechanism, it is possible to restrict the generation of an oxide slag in the melting furnace. This system is, however, likely to present a serious problem if the feed pipe or the valve fails or is broken during operation of the system. Any such failure is likely to result in all the molten alloy flowing out of the melting furnace. Moreover, the melting furnace needs to be situated at such a height that it is comparatively difficult to supply ingots of lead, etc., into the furnace and remove any oxide slag therefrom.

In a second known supply system, identified as an overflow system, the melting furnace need not be installed at a particularly high level, but a rotary pump is employed for supplying a molten lead alloy from the furnace to the casting machine so that it may enter the machine by overflowing its molten alloy inlet. This system does not have any of the drawbacks of the system which employs a head of the molten alloy. However, when the operation of the pump is discontinued, the resulting siphon effect causes all the molten alloy to flow back from the molten alloy inlet of the casting machine and the feed pipe to the melting furnace, which is located at a lower level. Air thus enters the feed pipe through the molten alloy inlet of the casting machine and oxidizes the lead alloy remaining on the inner surface of the feed pipe to form an oxide slag. An alloy of lead and calcium presents a particularly great problem. Moreover, the rotary motion of the pump and the overflow of the molten alloy promote the growth of the oxide slag.

A third supply system is known which employs a dispenser valve. While this system is an improvement over the overflow system, it has the disadvantage that it is necessary to seal the valve with an inert gas and remove an oxide slag from the valve frequently, as the slag adhering to the valve causes the molten alloy to leak out.

There are known a number of methods for heating the feed pipe. For example, gas is burned below the pipe, or the pipe is heated by an electric heating element which is wrapped around the pipe and which is surrounded by a heat insulating material. All of these methods are, however, inefficient.

SUMMARY OF THE INVENTION

It is, therefore, an object of this invention to provide a method and an apparatus which can restrict the generation of an oxide slag in a melting furnace and prevent the infiltration of air into a feed pipe and thus restrict the oxidation of a lead alloy in the feed pipe, thereby prolonging its life.

It is another object of this invention to provide an effective method of heating the feed pipe.

According to a first aspect of this invention, there is provided a method of supplying a molten lead alloy from a melting furnace to a casting machine through a pump and a feed pipe which comprises supplying the molten alloy through the feed pipe having a portion located at a level which is higher than the higher of the two levels of the molten alloy located adjacent to both ends, respectively, of the feed pipe by a distance exceeding the height of a column of the molten alloy which atmospheric pressure can support.

Electricity is directly supplied to the feed pipe for heating it and thereby the molten lead alloy which it contains. Its voltage is varied in accordance with the temperature of the feed pipe.

According to a second aspect of this invention, there is provided an apparatus for supplying a molten lead alloy from a melting furnace to a casting machine which comprises a feed pipe having a pair of ends connected to the furnace and the machine, respectively; a pump associated with the feed pipe for supplying the molten alloy thereinto to transport it from the furnace to the machine; and the feed pipe having an intermediate portion situated at a level which is higher than the higher of the two levels of the molten alloy located adjacent to the ends, respectively, of the feed pipe by a distance exceeding the height of a column of the molten alloy which atmospheric pressure can support.

The pump is preferably a piston pump comprising a piston housing having a pair of open ends and an inner surface formed from carbon or a ceramic material, a valve provided between the housing and the feed pipe and held by the back pressure of the molten alloy in the lead pipe in its closed position in which it closes one end of the housing, and a piston which is movable into the housing through the other end thereof and slidable along its inner surface to compress the molten alloy in the housing against the valve and thereby open it, the piston being formed from carbon or a ceramic material.

According to this invention, the molten lead alloy always fills the feed pipe and prevents any air from entering the feed pipe and oxidizing the alloy therein. Therefore, the feed pipe has a life of about three years, which is about five times longer than that of any conventional feed pipe, if the alloy to be cast is of lead and antimony, and a life of about two years, which is about ten times longer, if the alloy is of lead and calcium.

This invention has a number of advantages over the conventional overflow system employing a rotary pump. While it has hitherto been necessary to clean the feed pipe as often as, say, once a month, no such frequent cleaning is required of the feed pipe according to this invention. It is also possible to reduce to about a half the amount of the oxide slag which is formed in the melting furnace.

The direct application of an electric current to the feed pipe according to this invention can reduce by about 30% the cost which has hitherto been required for heating the feed pipe.

DETAILED DESCRIPTION OF THE INVENTION

Figure 1:
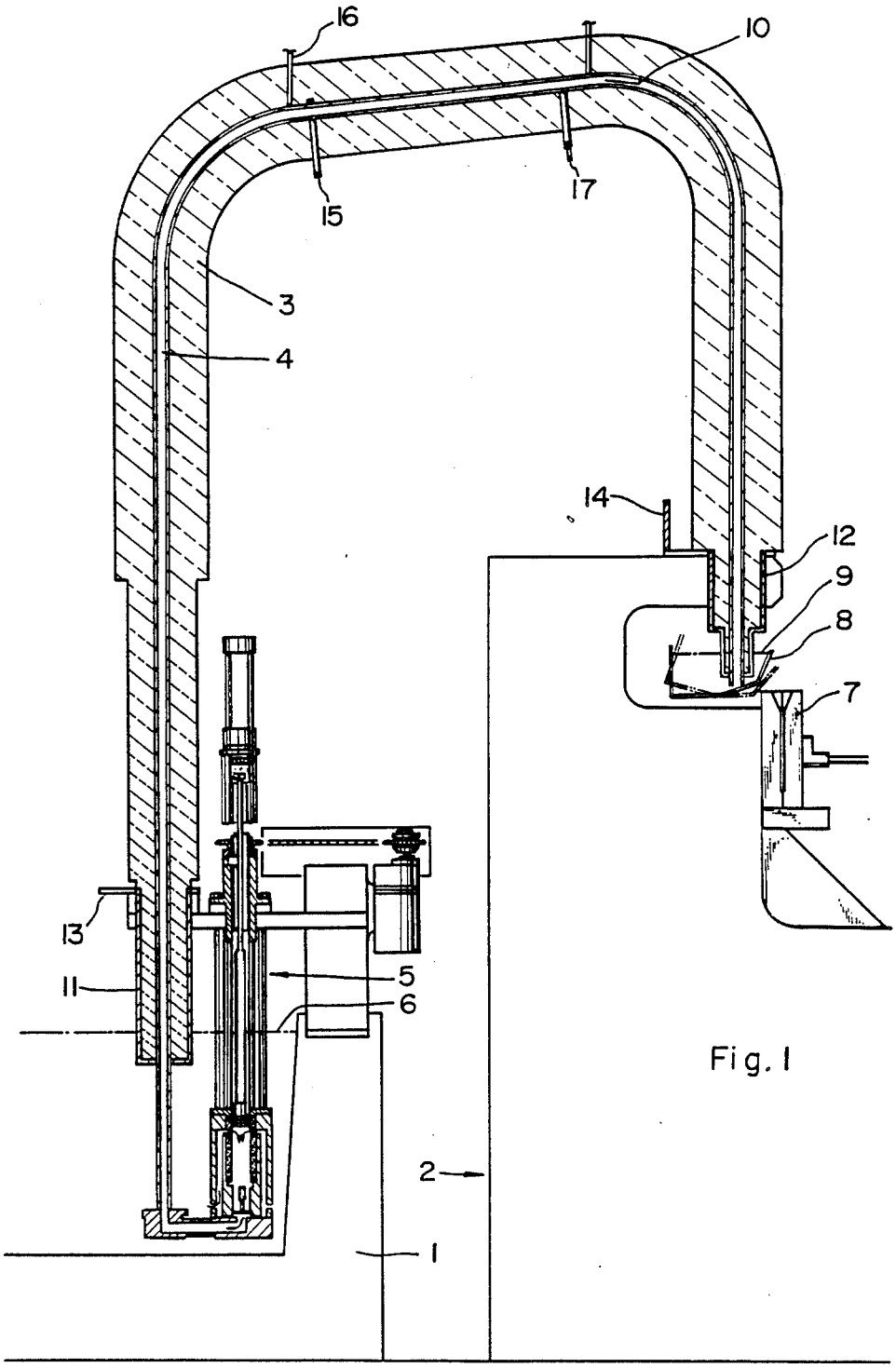
FIG. 1 is a front elevational view, partly in section, of an apparatus embodying this invention.

An apparatus embodying this invention is shown by way of example in FIG. 1. It includes a feed pipe 4 extending from a lead alloy melting furnace 1 to a casting machine 2. The feed pipe 4 is a carbon steel pipe of the type which is used in a high temperature pipeline, and is surrounded by a heat-insulating material 3 known as silica board. A piston pump 5 is provided for supplying a molten lead alloy from the melting furnace 1 to the casting machine 2 through the feed pipe 4.

The feed pipe 4 is substantially of the inverted U-shape and has two vertical leg portions of different lengths. It has a pair of open ends of which one is situated in the melting furnace 1, while the other end thereof is located in the casting machine 2. The end of the feed pipe 4 in the casting machine 2 is located at a higher level than the end located in the melting furnace 1. The casting machine 2 includes a swing bucket 8 which receives the molten alloy from the feed pipe 4 and pours it into a mold 7. The molten alloy in the bucket 8 has a surface level 9 which is higher than the level 6 of the molten alloy in the melting furnace 1. The feed pipe 4 includes a substantially horizontal intermediate portion which is slightly inclined and has a peak 10 located above the casting machine 2. The peak 10 is located at a level which is higher than the level 9 of the molten alloy in the casting machine 2 by a distance of about 1200 mm for the reason which will hereinafter be stated.

Lead has a specific gravity of 11.331 at 25° C. and molten lead has a specific gravity of 10.536 at 450° C. The lead alloys which are used for making grids for lead batteries are approximately equal to them in specific gravity. One atmosphere, which is approximately equal to 1033 g/cm$^2$, is the pressure which can support an approximately 980 mm high column of molten lead. Therefore, the peak 10 of the feed pipe 4 is located at a level which is about 1200 mm higher than the level 9 of the molten alloy in the casting machine 2, so that no siphon effect causing the molten alloy to flow back from the swing bucket 8 and the feed pipe 4 to the melting furnace 1 may take place when the operation of the pump 5 has been discontinued. The feed pipe 4 is always filled with the molten alloy and no air enters the feed pipe 4. Therefore, the alloy in the feed pipe 4 is not oxidized and the feed pipe 4 is not clogged with any oxidized alloy.

A steel pipe 11 surrounds a portion of the heat insulating material 3 adjacent to the melting furnace 1 and has a closed lower end welded to the feed pipe 4. Likewise, a steel pipe 12 surrounds a portion of the heat insulating material 3 adjacent to the casting machine 2 and has a closed lower end welded to the feed pipe 4.

An electric terminal 13 is welded to the steel pipe 11 and another terminal 14 to the pipe 12. A third terminal 15 is welded to the intermediate portion of the feed pipe 4. If the terminals 13 and 14 are electrically connected to each other and if an AC voltage is applied between the terminals 13 and 14 and the terminal 15, the electric current flows in two ways to the terminal 15, i.e., through the terminal 13, the pipe 11 and the feed pipe 4 and through the terminal 14, the pipe 12 and the feed pipe 4, and thereby heats the feed pipe 4 directly. A plurality of fixtures 16 are provided for suspending the feed pipe 4 from the beam of a factory building or other bracket.

The feed pipe 4 should be fed with an electric current not exceeding 20 A, as the application of a higher current shortens its life drastically. The feed pipe 4 increases its electrical resistance with a rise in temperature. Therefore, the voltage which is applied to the feed pipe 4 should be varied as its temperature rises. This voltage control can, for example, be achieved if a thyristor is used for keeping at about 15 A the electric current which is fed to the feed pipe. The use of a thyristor has, however, the disadvantage of being expensive.

According to this invention, therefore, a thermocouple 17 is employed for detecting the temperature of the feed pipe 4 having an overall length of about 460 cm and its output is used for controlling an electromagnetic switch not shown to supply a voltage of 2.6 V to the feed pipe 4 when it has a temperature up to 250° C., and a voltage of 3.2 V when it has a temperature of 250° C. to 450° C.

Figure 2:
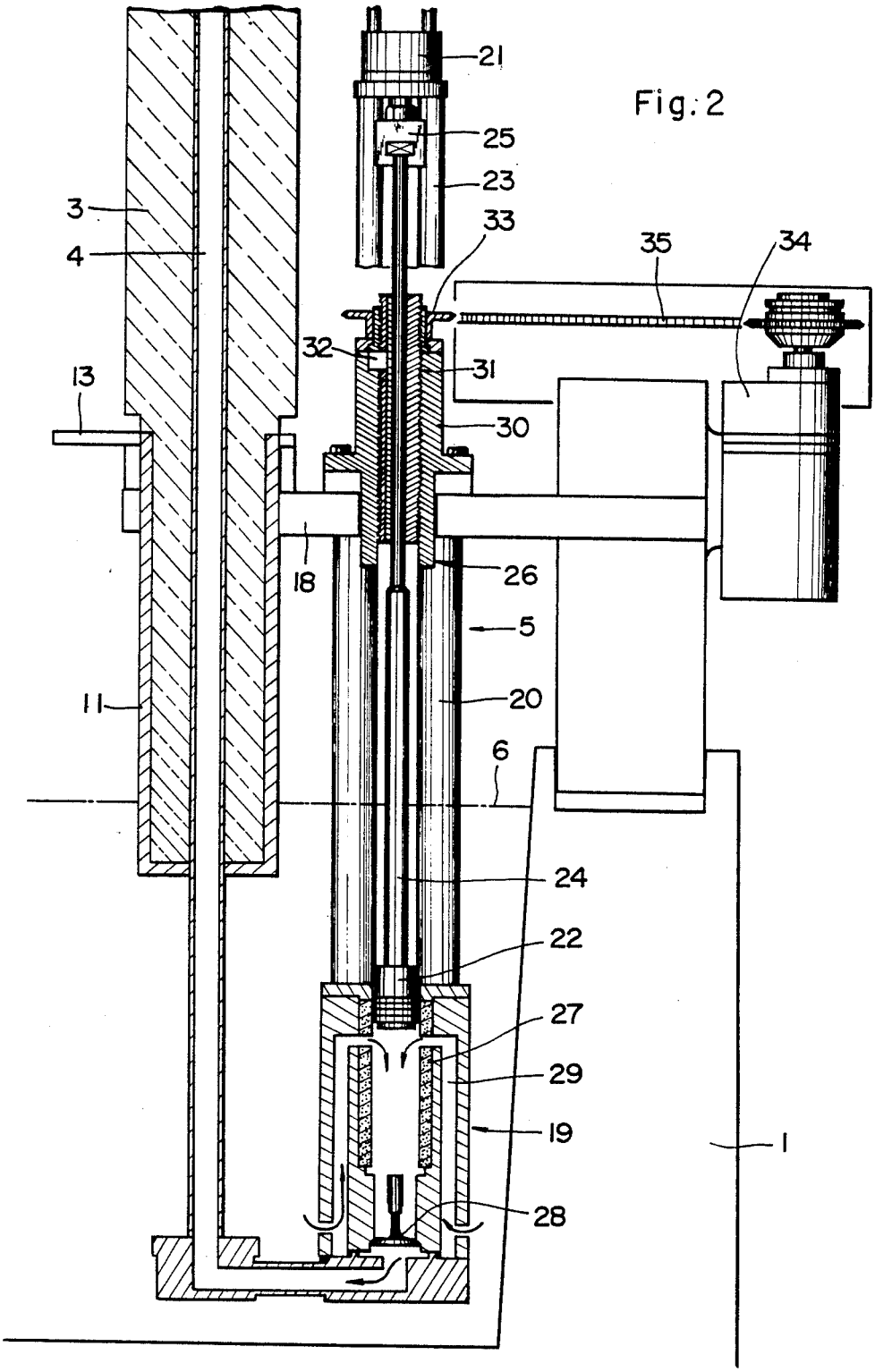
FIG. 2 is a detailed view of a part of FIG. 1.

Attention is now directed to FIG. 2 showing the piston pump 5 in detail. A base 18 is secured to the melting furnace 1 and the steel pipe 11 is secured to the base 18. The pump 5 includes a main body 19 disposed in the melting furnace 1 and supported from the base 18 by four bolts 20 in sleeves. A pneumatic cylinder 21 is also supported on the base 18 by four bolts 23 in sleeves. A vertical piston rod 24 carrying a piston 22 at its lower end has an upper end connected at 25 to the cylinder 21, so that the operation of the cylinder 21 may be transmitted to the piston 22. A piston movement control device 26 is provided between the main body 19 and the cylinder 21.

The main body 19 comprises an outer housing and an inner housing which is radially inwardly spaced apart from the outer housing. Each housing has a pair of open ends. The piston 22 is normally situated in the upper end of the outer housing. The upper end of the inner housing is spaced below the upper end of the outer housing. A route along which the molten alloy can flow from the melting furnace 1 to the feed pipe 4 through the pump 5 is formed through the wall of the outer housing, the space between the inner and outer housings and the interior of the inner housing, as is obvious from FIG. 2. The inner housing has an inner surface 27 along which the piston 22 is slidable when it is lowered or raised. A valve 28 is provided between the feed pipe 4 and the inner housing for closing or opening the lower end of the latter.

The pneumatic cylinder 21 is operationally associated with the swing bucket 8. If the cylinder 21 is actuated to lower the piston 22, it is moved down along the inner surface 27 of the inner housing and compresses the molten alloy therein against the valve 28, whereby the valve 28 is opened to allow the molten alloy to flow out into the feed pipe 4. If the piston 22 is raised, the valve 28 is closed by the back pressure of the molten alloy in the feed pipe 4 and the route 29 is opened to allow a fresh supply of molten alloy to flow into the inner housing. This sequence of operation is repeated for supplying the molten alloy through the feed pipe 4 continuously.

The piston 22 or the inner surface 27 of the inner housing or both are formed from carbon or a ceramic material. The use of other material, such as steel, should be avoided, as an oxide slag adhering to the piston 22 or the surface 27 prevents the smooth movement of the piston 22. The use of carbon or a ceramic material enables a prolonged life of the piston 22 or the surface 27 or both, as virtually no oxide slag adheres thereto.

The piston movement control device 26 includes a boss 30 and an adjust bolt 31 extending through the boss 30 and having a male screw thread on its outer surface. The piston rod 24 extends through the adjust bolt 31 and the outer surface of the bolt 31 has a key groove in which a key 32 is fitted to prevent the rotation of the bolt 31 about its axis, while allowing it to move vertically. A sprocket 33 has a female screw thread meshing with the male screw thread on the bolt 31. The sprocket 33 is rotatable by a chain 35 through which the rotation of an electric motor 34 provided with a reduction gear is transmitted to the sprocket 33. The rotation of the sprocket 33 causes the vertical movement of the adjust bolt 31. The piston rod 24 is vertically movable through the bolt 31 to lower or raise the piston 22, but as soon as the member 25 to which the rod 24 is connected abuts on the upper end of the bolt 31, the piston 22 can no longer be lowered. The bolt 31 is moved vertically to control the downward movement of the piston 22 and thereby the amount of the molten alloy which is supplied into the swing bucket 8. The motor 34 is rotated in one direction to raise the adjust bolt 31 if the amount of the molten alloy being supplied is too large and is likely to form any undesirable burr on a grid being manufactured. On the other hand, the motor 34 is rotated in the opposite direction to lower the bolt 31 if the amount of the molten alloy being supplied is too small.

The valve 28 may comprise a disk-shaped member as shown in FIG. 2, or may alternatively comprise a ceramic or steel ball.

While the invention has been described with reference to a preferred embodiment thereof, it is to be understood that modifications or variations may be easily made by anybody of ordinary skill in the art without departing from the scope of this invention which is defined by the appended claims.

What is claimed is:

1. In a method of supplying a molten lead alloy from a melting furnace to a casting machine used for manufacturing grids for lead accumulators, the improvement which comprises supplying the molten lead alloy through a piston pump and a feed pipe, said piston pump being driven by a pneumatic cylinder to supply the molten alloy from the melting furnace to a swing bucket of the casting machine through the feed pipe, and said feed pipe provided between the melting furnace and the swing bucket which pours the supplied molten lead alloy into a mold and having both open ends, one of which being positioned at a level which is lower than the level of the molten metal in the melting furnace and the other being positioned at a level which is lower than the level of the molten lead alloy in the swing bucket, said feed pipe further having an intermediate portion location at a level which is higher than the higher of the two levels of the molten lead alloy located adjacent to the both open ends, respectively, of said feed pipe by a distance exceeding the height of a column of the molten lead alloy which atmospheric pressure can support, and said piston pump being provided with a valve which is closed by the back pressure of the molten lead alloy in the feed pipe and opened by the pressure of the molten lead alloy to be applied to the valve, whereby the molten lead alloy always fills the feed pipe and prevents any air from entering the feed pipe, the pump is operationally associated with the swing bucket and an adjust bolt, through which a piston rod connecting the pneumatic cylinder to a piston extends, is vertically moved so as to allow the piston to be no longer lowered when the lower end of a member to which the piston rod is connected abuts on the upper end of the adjust bolt, thereby adjusting the feeding amount of the molten lead alloy corresponding to one stroke of the piston.

2. A method as set forth in claim 1, including the step of supplying an electric current directly to said feed pipe for heating the molten lead alloy therein.

3. A method as set forth in claim 1, including the step of varying a voltage of said electric current to be applied to said feed pipe in accordance with the temperature of said feed pipe.

4. An apparatus for supplying a molten lead alloy from a melting furnace to a casting machine, which comprises a feed pipe extending from said melting furnace to a swing bucket for pouring the molten alloy into a mold;

a piston pump driven by a pneumatic cylinder for supplying the molten alloy from said melting furnace to said swing bucket of said casting machine through said feed pipe;

said feed pipe having opposite open ends, one of which is positioned at a level which is lower than a level of molten metal in the melting furnace and another is positioned at a level which is lower than the level of the molten alloy in the swing bucket, said feed pipe further having an intermediate portion located at a level which is higher than the higher of the two levels of the molten alloy located adjacent to the both open ends, respectively, of said feed pipe by a distance exceeding the height of a column of the molten alloy which atmospheric pressure can support said piston pump being provided with a valve which is closed by the back pressure of the molten lead alloy in the feed pipe and a piston which compresses the molten lead alloy against said valve to open it, said piston pump being operationally associated with the swinging motion of said swing bucket; and an adjust bolt, through which a piston rod connecting the pneumatic cylinder to a piston extends, is vertically moved so as to allow the piston to be no longer lowered when the lower end of a member to which the piston rod is connected abuts on the upper end of the adjust bolt, thereby adjusting the feeding amount of the molten lead alloy corresponding to one stroke of the piston.

5. An apparatus as set forth in claim 4, wherein at least one of the inner surfaces of the piston and the pump of said piston pump is formed from carbon.

6. An apparatus as set forth in claim 4, wherein at least one of the inner surfaces of the piston and the pump of said piston pump is formed from a ceramic material.

* * * * *